US005533912A

United States Patent [19]

Fillinger et al.

[11] Patent Number: 5,533,912

[45] Date of Patent: Jul. 9, 1996

[54] SUBMERSIBLE ELECTRICAL SET SCREW CONNECTOR

[75] Inventors: David R. Fillinger, Cincinnati, Ohio; Jeffrey D. Church, Pinehurst, N.C.

[73] Assignee: Erico International Corp., Solon, Ohio

[21] Appl. No.: 376,868

[22] Filed: Jan. 23, 1995

[51] Int. Cl.[6] ..... H01R 13/52

[52] U.S. Cl. ..... 439/521; 439/718

[58] Field of Search ..... 439/201, 204, 439/135, 136, 149, 451, 519–521, 718

[56] References Cited

U.S. PATENT DOCUMENTS

| | | | |
|---|---|---|---|
| 3,829,823 | 8/1974 | Dumesnil | 439/923 X |
| 5,006,078 | 4/1991 | Crandall et al. | 439/521 |
| 5,338,898 | 8/1994 | Luciano et al. | 439/521 X |
| 5,346,782 | 9/1994 | Julian | 439/521 X |

*Primary Examiner*—Khiem Nguyen
*Attorney, Agent, or Firm*—Renner, Otto, Boisselle & Sklar

[57] ABSTRACT

A submersible set screw connector has a conductive metal block with a series of blind conductor holes and corresponding set screws to clamp and secure the conductor ends to the block. The connector is provided with a waterproof case which includes elongated grommet receiving sleeves for each conductor. Access to the set screws is provided through cylindrical projecting ports, each of which includes a waterproof plug. Each plug is tethered to the case so it can not be lost. The tether extends from a small hole in a radial tab on the plug to a small hole on a fin projecting from the case. The tab keeps the tether radially outside the cylindrical projecting ports. The plug and port are configured to interfit to form a tight seal.

16 Claims, 2 Drawing Sheets

SUBMERSIBLE ELECTRICAL SET SCREW CONNECTOR

DISCLOSURE

This invention relates generally as indicated to a submersible electrical set screw connector, and more particularly to a set screw connector for use in submerged or underground installations.

BACKGROUND OF THE INVENTION

Junction connectors of the set screw bar type have been used for many years. Such connectors comprise extruded bodies of aluminum or copper-aluminum alloy for example, and which may be generally square in transverse section. One face is provided with two or more conductor receiving blind holes. A second face 90° to such first face has corresponding and intersecting blind tapped holes which receive set screws usually having recessed hex heads. A conductor is inserted into a blind conductor receiving hole when the set screw is backed-off. The set screw is tightened down on the conductor to clamp it to the body or bar of aluminum. Other conductors are secured in the same way. The number of such connections may be from 2 to 8 or, even more. Such connectors are widely used for connections for power distribution from transformers.

In the past, many transformers were mounted on poles, and still are. However, much new electrical distribution today is underground. This includes not only the conductor but the transformer and the set screw connector. The connections are usually made below grade in a vault or fairly deep hole with confined space. Many such connections are made in mud or muddy water. If the connection is not below water initially, over its service life, it will be due to rains or floods or even normal seasonal fluctuations of ground water.

In order to provide such connectors with a longer serviceable life, submersible connectors have been developed. Such connectors are provided with a molded waterproof encasement. Problems, however, arise both where the conductors enter the case and more particularly where access to the set screw is required.

The case usually includes long projecting sleeves at the conductor ports which are plugged with elongated grommets which are termed rockets. The rockets include stepped tips which are out off at a selected step depending on the size of the conductor. The conductor is inserted through the cut-off tip of the rocket which now becomes an elongated sleeve grommet. Both are inserted into the long sleeve of the case with the grommet sealing against the interior of the sleeve and the projecting tip of the conductor extending beneath the path of the set screw. The preparation and insertion of the conductor usually requires at least two hands of a lineperson.

The access to the set screw is through a port provided by a somewhat shorter cylindrical sleeve projection. The port is provided with a removable cap or plug which is supposed to provide a watertight connection. When the plug is removed, access is provided to the recessed hex head set screw.

The submersible connection in each of the paired sleeve ports include the rocket and the watertight plug. When the connection is initially installed, only some of the paired ports may be used and additional connections may be made later, or even much later.

When a connection is made, the rocket is removed and the proper sleeve grommet is fashioned and inserted on the end of the conductor. Before inserting the conductor, the lineperson has to remove the plug on the corresponding set screw port sleeve projection and make sure the set screw is backed out. This is done by inserting a hex driver such as an Allen wrench and backing out the set screw. Only then is the conductor inserted to a position to be clamped by the set screw. Because of the tight connection of the plug in its sleeve, such plugs usually have to be removed with a pair of pliers. In fact, most such plugs are provided with a center projecting tab to enable them to be gripped by a pair of pliers. The set screw is then tightened with the hex driver and the electrical connection is made. While the grommet seals the conductor port, the cap has to be replaced and properly seated to maintain the waterproof integrity of the case. The lineperson has to perform all of the above steps usually with heavy gloves on, and in cramped dark, and wet space. It is not uncommon for the bottom of the space to be filled with muddy water.

While the lineperson may be wearing a tool belt, and can readily put down or pick up the tools, the lineperson has no place to put the plug. The plug is, in fact, often dropped, and often after the connection is made, the lineperson may wind up groping in the mud or water to retrieve the plug.

The problem is made worse by the fact that the material of the case and cap is usually rubber or an EDPM, which is black. This makes for an excellent camouflage. Some makers of submersible connectors paint the caps yellow, but they are still lost.

If the plug can not be found readily, the common practice is to cover the port hole with a strip or strips of electrical tape, which is a makeshift seal, if a seal at all. For many years, the major cause of failure of this type of connector is the loss of watertight caps and plugs. No plug or a makeshift plug allows water to penetrate the connector.

It would, therefore, be desirable to have a submersible electrical set screw connector which could more easily be used in the cramped and wet environment of an underground connection to a transformer. It would also be desirable to have such a connector where the caps or plugs could not get lost and would remain handy to the lineperson efficiently to complete a long lasting failure free set screw connection.

SUMMARY Of THE INVENTION

A submersible set screw connector has an aluminum or conductive alloy body of a generally square or rectangular cross section. The body contains a number of blind holes to receive conductors and tapped holes at right angles to the blind holes receiving set screws. Conductors may be secured to the body simply by inserting a bare end of the conductor into the hole and then tightening the set screw to clamp the conductor end firmly against the wall of the blind hole opposite the set screw. The metal body is covered in a molded waterproof case of substantial thickness, which has sleeve ports for the conductors and for access to the set screws. The case is molded and the sleeve ports are provided with waterproof caps or plugs which seat substantially into the sleeve and when closed seal the case.

Each cap or plug is provided with an axially projecting center tab and a stop flange to seat on top of the sleeve. The center tab enables the plug readily to be gripped by pliers for removal. The interior of the sleeve and the exterior of the projecting shank of the plug or cap are deformed to interfit to provide the waterproof seal when the plug is inserted to the stop flange.

Projecting radially from the stop flange is a small tab with a central small hole which is radially beyond or offset from the sleeve yet parallel to the sleeve axis. A nylon monofilament tether is inserted through the hole with the opposite end of the tether inserted through a small hole in a fin or gusset between or adjacent conductor port sleeves and the main body of the case. In this manner, each cap or plug is tethered to the body case and will just hang on the tether a short distance from the set screw port when open, and the lineperson is manipulating the set screw. The small tab for the tether is an extension of the stop flange and its location clears the exterior of the sleeve projection to prevent the tether from tangling between the cap and sleeve. With the connector of the present invention, a secure watertight and failure free connection can more easily be made in an inhospitable environment.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
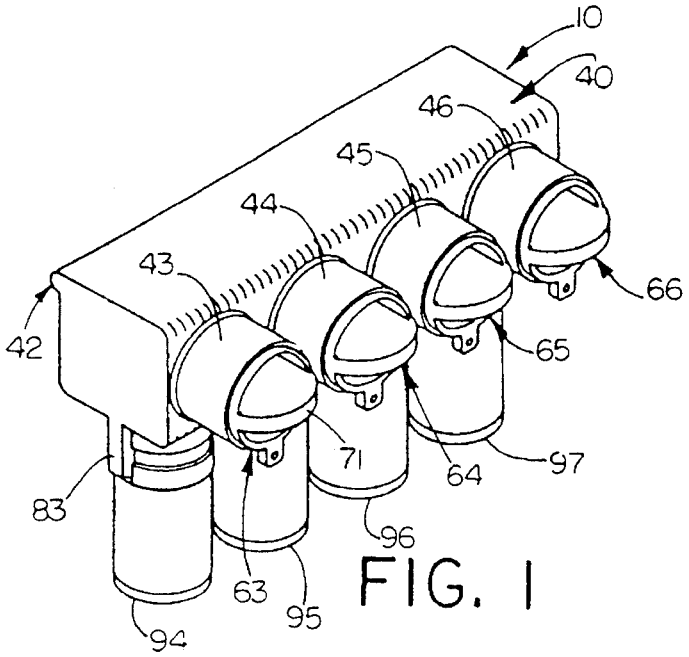
FIG. 1 is a perspective view of a submersible set screw connector in accordance with the present invention which will accommodate four conductors.
Figure 2:
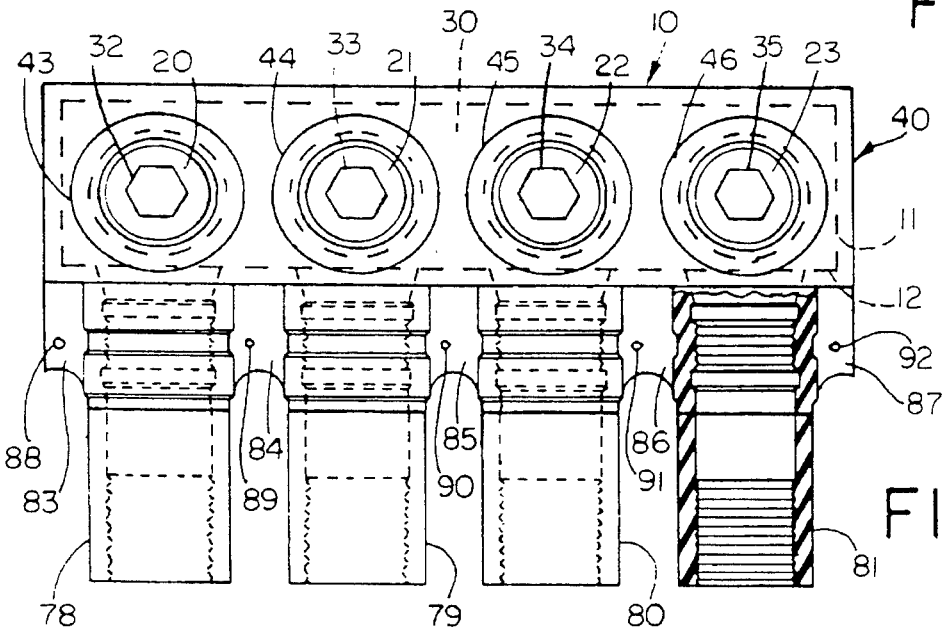
FIG. 2 is a plan view partially broken away and in section of the connector without the caps or plugs and without the rockets.
Figure 3:
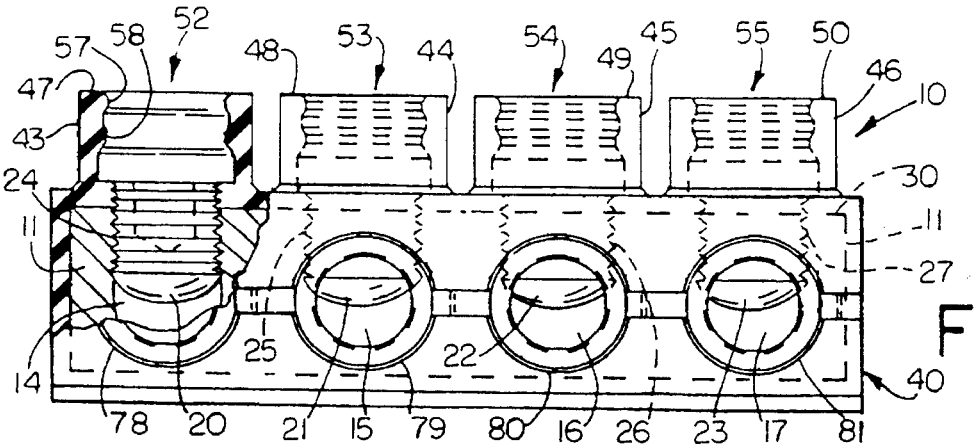
FIG. 3 is an elevation of the connector seen in FIG. 2 partially broken away and in section.

Referring initially to FIGS. 1, 2 and 3, there is illustrated a submersible electrical set screw connector shown generally at 10 which is adapted to receive up to four insulated electrical conductors. The connector includes an aluminum or like conductive alloy such as aluminum-copper metal block 11 which is elongated and roughly square or rectangular in transverse section. In one face 12, which is the bottom face in FIG. 2 and the face facing the viewer in FIG. 3, there is provided a series of blind conductor receiving holes indicated at 14, 15, 16 and 17. The holes are deep enough to underlie set screws 20, 21, 22 and 23, respectively, which are threaded in tapped holes 24, 25, 26 and 27, respectively, which are in the face 30 of the block which is the top face in FIG. 3 or the face facing the viewer in FIG. 2. Each set screw has a hex recess as seen at 32, 33, 34 and 35, respectively. In this manner, the screws may be turned by a hex driver such as an Allen wrench.

With the set screw backed off, the bare end of an insulated conductor is inserted beneath the set screw and then the set screw is tightened to clamp the conductor against the wall of the block opposite the set screw. Accordingly, good electrical connection is made between the conductor and the block. In the four conductor embodiment shown, as an example, one of the conductors may extend to a transformer while the other three extend to customers such as separate houses or buildings.

The block 11 is completely enclosed with a waterproof enclosure or case indicated generally at 40. The case 40 encapsulates the block in an injection molding process. The case is preferably made of a rubber such as EPDM (ethylene, propylene diene monomer). The case is fairly thick and includes a reinforcing ridge 42 running along the top back edge seen in FIG. 1. Axially aligned with the set screw holes in the block, the case is provided with cylindrical projections 43, 44, 45 and 46. These cylindrical projections 43–46 terminate in annular faces 47, 48, 49 and 50, respectively. Such faces define cylindrical projecting ports 52, 53, 54 and 55, for access to the respective set screws.

As indicated more clearly in FIG. 3, the interior of each cylindrical projection defining such ports is provided with two axially spaced inwardly projecting ridges seen at 57 and 58. The ridges and the adjacent valleys are designed to interfit with the ridges 60 and 61 as well as the adjacent valleys on the stem 62 of a plug or cap 63, which is shown in detail in FIGS. 4 and 5. There is, of course, provided a plug or cap for each of the cylindrical projections as seen at 64, 65 and 66 for the projections 44, 45 and 46, respectively, as seen in FIG. 1. The stem of each cap as seen in FIG. 5 is designed to fit down inside the cylindrical projection of each set screw port to a significant extent and such insertion is limited by a seating flange indicated at 68 and the underside 69 of such flange seats, for example, on the annular face 47 seen in FIG. 3.

Figure 4:
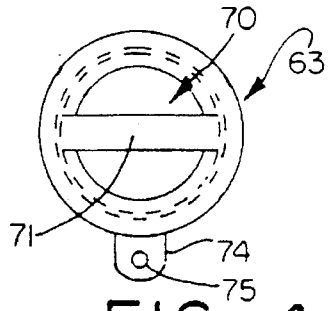
FIG. 4 is an enlarged axial top view of the plug or cap.
Figure 5:
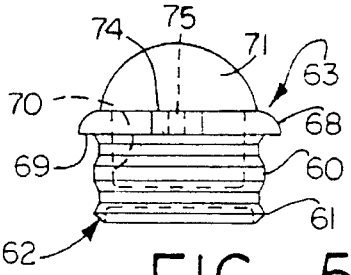
FIG. 5 is an elevation of the plug or cap.

The outer center of the plug is hollow as seen at 70 in FIGS. 4 and 5. The hollow center 70 is diametrically divided by an axially projecting grip tab 71 which projects substantially beyond the abutting flange 68. The hollows on each side of the grip tab and its significant projection enable the lineperson to grip the plug with a pair of pliers to remove it from the respective cylindrical projection. Otherwise removal may be difficult, especially with a pair of heavy gloves.

Each plug includes a radially projecting tab 74 having a centered axial small through-hole 75. The tab 74 projects radially from the stop or seating flange 68. The hole 75 is thus positioned radially outside the exterior of the cylindrical projection or port sleeve 43 when the plug is inserted in the port 52.

The molded waterproof case also includes rather longer cylindrical projections seen at 78, 79, 80 and 81. Such cylindrical projecting sleeves are considerably longer than the sleeves forming the ports for the plugs 63–66 and where the sleeve joins the body of the case surrounding the block 11, there are provided projecting fins or gussets as seen at 83, 84, 85, 86 and 87. Each of the fins or gussets is provided with a small through-hole as indicated at 88, 89, 90, 91 and 92, respectively. The holes 88–92 are of the same size as the hole 75 in the tab 74 in each plug. The fins or gussets help stabilize the projecting sleeves 78–81 and also provide a place for such holes. The sleeves 78–81 receive rockets, the ends of which are shown at 94, 95, 96 and 97 in FIG. 1. Although the rockets and plugs are omitted in FIGS. 2 and 3, each assembled submersible electrical set screw connector will include a plug and a rocket in each of the respective cylindrical port projections.

Figure 7:
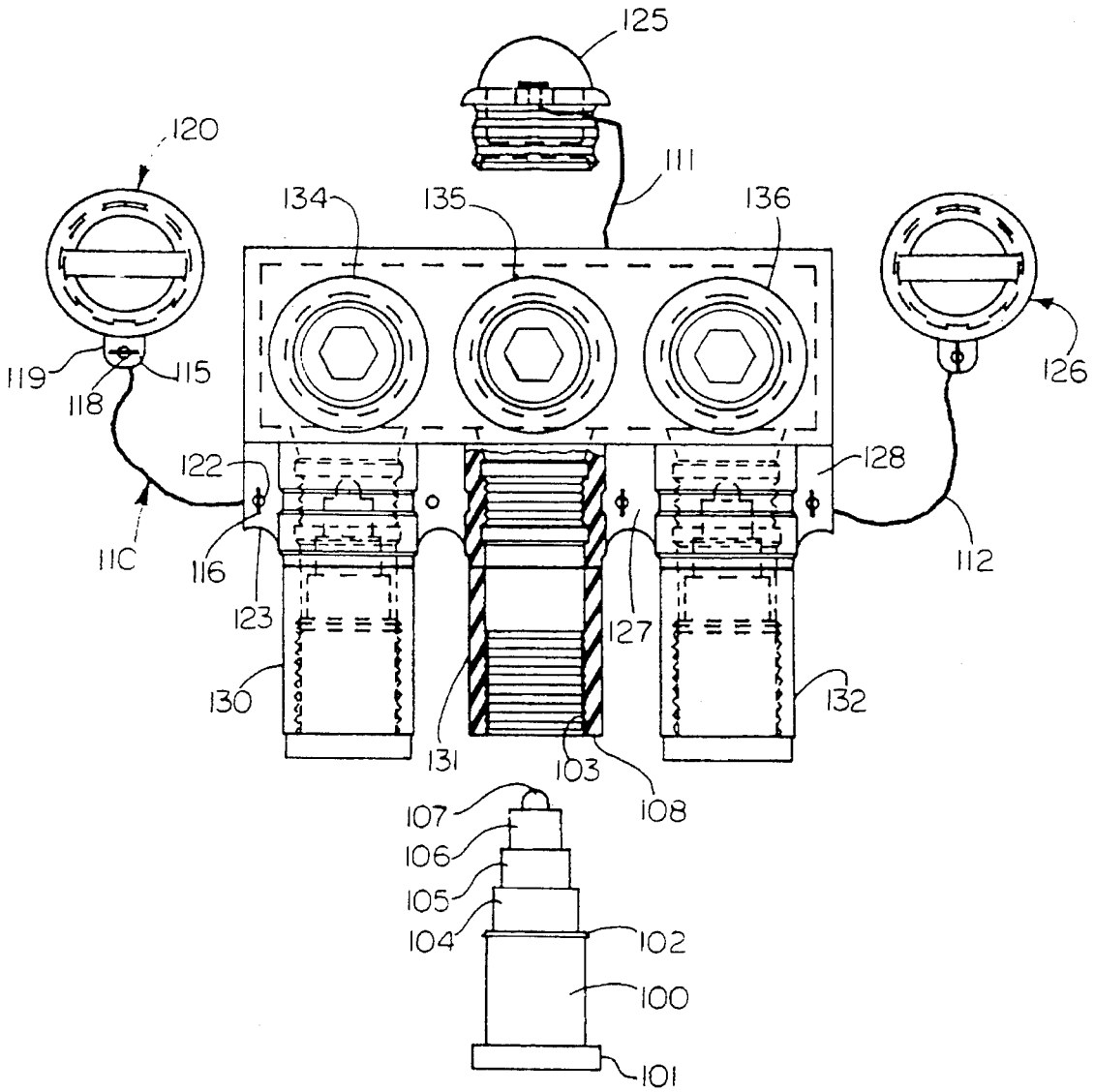
FIG. 7 is an assembly view of a three conductor submersible connector partially broken away and in section showing the respective plugs or caps, and tethers, as well as the rockets.

The detail of the rocket is seen in FIG. 7 in a three conductor embodiment of the present invention. FIG. 7 illustrates the center rocket removed while the conductor ports on the opposite sides of the center port include the rockets inserted. Other than accommodating three conductors instead of four, the submersible set screw connector of FIG. 7 is the same as the four conductor connector seen in FIGS. 1, 2 and 3.

As seen more clearly in FIG. 7, each rocket comprises a sleeve 100 made of the same material as the case which is hollow and which includes a stop shoulder 101 on its outer end. The sleeve 100 at its inner end includes a ridge 102 which is deformed by and closely interfits with a series of annular ridges 103 on the inside of the conductor sleeve. Inwardly beyond the ridge 102 the rocket is provided with stepped projections indicated at 104, 105, 106, and finally, a projecting tip 107.

To insert the conductor, the rocket is removed from the cylindrical projection and the inner stepped tip is cut off to an extent depending upon the size of the conductor being inserted. The process is fairly complex and involves the application of grease and the preparation of the end of the conductor which must project properly and be free of insulation where it is to be clamped by the set screw or block. The bare conductor has to project far enough to be properly engaged by the set screw when it is clamped down on the conductor bare end. When properly formed, the rocket then becomes an elongated sleeve grommet for the insertion of the conductor and the sleeve and conductor are inserted into the respective port until the stop shoulder 101 engages the port face at 108 as seen in FIG. 1, as at the right and left hand side of FIG. 7.

Figure 6:
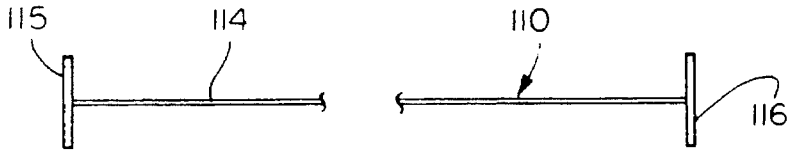
FIG. 6 is an illustration of the tether used to connect each plug or cap and the molded case.

In order to prevent the set screw port plugs from being lost when they are removed from the submersible set screw connector, each of the plugs is provided with a flexible tether such as seen at 110, 111 and 112 in FIG. 7 and as shown in detail in FIG. 6. The tether 110 seen in FIG. 6 comprises a length 114 of a plastic monofilament which at each end has integrally formed therewith transversely extending rather heavier T-heads seen at 115 and 116. The length of relatively small monofilament 114 is quite strong in tension but also quite laterally flexible. The transverse T-heads 115 and 116 are more rigid and not as laterally flexible. This enables the monofilament to be bent alongside a head, and then an end of the head may be used as a needle to put the end of the tether 110 through the hole 118 in tab 119 in the plug 120 seen in FIG. 7. The opposite end of the tether 116 is inserted in similar fashion through the hole 122 in the fin 123. The tethers 111 and 112 for the plugs 125 and 126, respectively, are attached in the same way to the respective fins or gussets 127 and 128.

The length of the tether may vary. In the illustrated embodiment, the length is approximately 12.5 cm and is design to permit the plug to hang about twice the length of the cylindrical conductor port projections 130, 131 and 132. As can be seen in FIG. 7, the position of the hole 118 in the tab 119 is such that the tether 110 is positioned radially outside of the cylindrical projecting port 134. Similarly, the tethers 111 and 112 will be fastened to the plugs 125 and 126 radially outside of the cylindrical projecting ports 135 and 136, respectively. The three conductor connector as seen in FIG. 7 is otherwise identical to the four conductor connector seen in FIGS. 1, 2 and 3. It is noted in both embodiments that the fins which stabilize the cylindrical projecting conductor ports and which provide the small holes by which the tether is connected to the case, leave one hole with no tether connection since there is always one additional fin and hole as compared to set screw port plugs.

As indicated, the submersible set screw connector includes the thick waterproof case and also a plug in each set screw port as well as a rocket in each conductor port. To make a connection, the lineperson removes a rocket and prepares the conductor end and assembles it with the rocket. When the conductor and grommet are properly assembled and prepared, the lineperson has to be certain that the respective clamping set screw is sufficiently backed out to enable the conductor to be inserted to an extent that it can be clamped by the set screw. To do this the lineperson removes the respective plug and if required backs out the set screw. To do this the plug has to be set down or released and a hex driver employed. When the set screw is backed out, the conductor is inserted and the set screw is clamped down tight on the projecting end of the conductor. The plug is then replaced being driven into the set screw port so that the ridges and valleys on the stem of the plug interfit with the ridges and valleys on the interior of the cylindrical projecting port. A watertight long lasting connection is made and the sealing of the set screw port does not have to be jury rigged or done with tape.

It can now be seen that there is provided a submersible electrical set screw connector which can more easily be used in the cramped and wet environment of an underground connection to a transformer. It will also be seen that the plugs to the set screw ports can not get lost and remain handy to the lineperson to enable an efficient completion of a long lasting failure free set screw connection.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A submersible electrical set screw connector comprising a metal conductive block, a plurality of blind conductor holes in said block, each adapted to receive a conductor, and a transversely extending set screw for each conductor hole adapted to be clamped down on the respective conductor received in the respective blind hole in said block to secure said conductor to said block and form an electrical connection, a molded waterproof case for said block, said molded waterproof case including tubular grommet receiving extensions at each blind conductor hole, said case also having cylindrical projecting ports corresponding to and in axial alignment with each set screw in said block, each cylindrical projecting port having a cylindrical interior and an axially projecting face, a waterproof plug for each cylindrical projecting port, each plug including a radial tab projecting radially of said axially projecting face, and a flexible tether securing said tab to said molded waterproof case.

2. A connector as set forth in claim 1 including molded gussets extending from said tubular extensions to the body of the case.

3. A submersible electrical set screw connector comprising a metal conductive block, a plurality of blind conductor holes in said block, each adapted to receive a conductor, and a transversely extending set screw for each conductor hole adapted to be clamped down on the respective conductor received in the respective blind hole in said block to secure said conductor to said block and form an electrical connection, a molded waterproof case for said block, said molded waterproof case including tubular grommet receiving extensions at each blind conductor hole, said case also having cylindrical projecting ports corresponding to and in axial alignment with each set screw in said block, each cylindrical projecting port having a cylindrical interior and an axially projecting face, a waterproof plug for each cylindrical projecting port, each plug including a flexible tether securing said plug to said molded waterproof case, molded gussets extending from said tubular extensions to the body of the case, a radial tab on each said plug, and small holes in each tab and gusset, said tether extending through the hole in the tab of the respective plug, and through a hole in a gusset.

4. A connector as set forth in claim 3 wherein said tether comprises a length of plastic monofilament with a relatively stiffer transverse T-head at each end to enable the monofilament to be inserted through the respective holes for each, but to resist pulling out, thus attaching each plug to the case to the leashed extent permitted by the tether.

5. A connector as set forth in claim 4 wherein each plug includes a stop flange adapted to seat on the end of the respective cylindrical projecting port, said tab projecting radially beyond the cylindrical projection of the port and the stop flange to position the hole and thus the tether connection radially beyond the cylindrical projection of the port.

6. A connector as set forth in claim 5 wherein each plug includes a projecting portion extending from the stop flange and adapted to telescope into the respective cylindrical projection.

7. A connector as set forth in claim 6 including interfitting annular ridges and grooves on the exterior of the plug projecting portion and the interior of the case cylindrical projection.

8. A connector as set forth in claim 7 wherein each plug includes an axially projecting center tab diametrically dividing a hollow to enable the plug to be gripped by a pair of pliers.

9. A submersible electrical set screw connector comprising a metal conductive block, a plurality of blind conductor holes in said block, each adapted to receive a conductor end, and a transversely extending set screw for each conductor hole adapted to be clamped on said respective conductor end received in said block to secure said conductor to said block and form an electrical connection, a waterproof case for said block, said case having cylindrical projecting ports corresponding to and in axial alignment with each set screw in said block, each cylindrical projecting port of said case having a cylindrical interior and an axially projecting face, a waterproof plug for each cylindrical projecting port, each plug fitting inside the respective cylindrical projecting port to seal the interior thereof, and a respective flexible tether securing each said waterproof plug to said molded waterproof case.

10. A connector as set forth in claim 9 including a small hole in each plug, and a respective small hole in the case, said respective flexible tether extending through said holes.

11. A connection as set forth in claim 9 including interfitting annular ridges and grooves on the exterior of the plug projecting portion and the interior of the case cylindrical projection.

12. A connection as set forth in claim 11 wherein each plug includes an axially projecting center tab to enable the plug to be gripped by a pair of pliers.

13. A submersible electrical set screw connector comprising a metal conductive block, a plurality of blind conductor holes in said block, each adapted to receive a conductor end, and a transversely extending set screw for each conductor hole adapted to be clamped on said respective conductor end received in said block to secure said conductor to said block and form an electrical connection, a waterproof case for said block, said case having cylindrical projecting ports corresponding to and in axial alignment with each set screw in said block, each cylindrical projecting port of said case having a cylindrical interior and an axially projecting face, a waterproof plug for each cylindrical projecting port, each plug fitting inside the respective cylindrical projecting port to seal the interior thereof, a flexible tether securing said waterproof plug to said molded waterproof case, a small hole in each plug, and a respective small hole in the case, said flexible tether extending through said holes, said tether comprising a length of plastic monofilament with a relatively stiffer transverse T-head at each end to enable the monofilament to be inserted through the respective holes for each, but to resist pulling out, thus attaching each plug to the case to the leashed extent permitted by the tether.

14. A connector as set forth in claim 13 including fins projecting from the case, the respective small hole for each plug tether being in one of said fins.

15. A connection as set forth in claim 14 including a radial tab projecting from each plug beyond the cylinder of the port, the small hole in each plug being in said tab radially beyond the respective cylindrical projecting port.

16. A connector as set forth in claim 14 wherein said case includes a cylindrical grommet receiving projection for each blind hole, said fins comprising gussets extending between the case and each cylindrical grommet receiving projection.

* * * * *